US007387658B2

(12) United States Patent
Grearson et al.

(10) Patent No.: US 7,387,658 B2
(45) Date of Patent: Jun. 17, 2008

(54) METHOD OF MAKING A CEMENTED CARBIDE POWDER MIXTURE AND THE RESULTING CEMENTED CARBIDE POWDER MIXTURE

(75) Inventors: Alistair Grearson, West Midlands (GB); Jonathan Fair, West Midlands (GB); Rickard Sandberg, Vaxholm (SE)

(73) Assignee: Sandvik Intellectual Property AB, Sandviken (SE)

( * ) Notice: Subject to any disclaimer, the term of this patent is extended or adjusted under 35 U.S.C. 154(b) by 211 days.

(21) Appl. No.: 11/472,550

(22) Filed: Jun. 22, 2006

(65) Prior Publication Data

US 2007/0006678 A1 Jan. 11, 2007

(30) Foreign Application Priority Data

Jun. 27, 2005 (SE) ..... 0501488

(51) Int. Cl.
*B22F 1/00* (2006.01)
*C22C 29/00* (2006.01)

(52) U.S. Cl. ..... 75/252; 75/231; 419/14; 419/36

(58) Field of Classification Search ..... 75/252, 75/231, 236; 419/14, 36, 37
See application file for complete search history.

(56) References Cited

U.S. PATENT DOCUMENTS 3,410,684 A 11/1968 Printz
3,859,056 A * 1/1975 Hara et al. ..... 428/539.5
4,070,184 A * 1/1978 Scheithauer, Jr. et al. .... 419/18
4,478,888 A 10/1984 Benjamin et al.
4,886,638 A * 12/1989 Penkunas et al. ..... 419/33

FOREIGN PATENT DOCUMENTS

EP 1 043 413 10/2000

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

A method of making cemented carbide at which powders forming hard constituents and powders forming binder phase are wet milled together with a pressing agent is disclosed. The slurry is dried, preferably by spray drying, compacted into bodies of desired shape and sintered. A cemented carbide powder with a reduced compacting pressure at a predetermined weighing in of 18% shrinkage can be obtained by using from about 1 to about 3 wt-% pressing agent with the following composition: less than about 90 wt-% PEG and greater than about 10 wt-% of long chain C≧20 fatty acids, their esters and salts, in particular, erucic acid and/or behenic acid. The invention also relates to a cemented carbide powder with low compaction pressure.

20 Claims, No Drawings

METHOD OF MAKING A CEMENTED CARBIDE POWDER MIXTURE AND THE RESULTING CEMENTED CARBIDE POWDER MIXTURE

BACKGROUND OF THE INVENTION

The present invention relates to a method of making cemented carbide powders with low compaction pressure, in particular submicron- and nano-sized powders.

Cemented carbide is made by wet milling of powders forming hard constituents, powders forming binder phase and pressing agents (generally PEG or polyethylene glycol) to a slurry, drying the slurry generally by spray drying, tool pressing the dried powder to bodies of desired shape and finally sintering. During sintering the bodies shrink about 16-20% linearly. The shrinkage depends on the % of theoretical density achieved during compaction of the powder to produce the green body (="green density"), which in turn depends upon pressing pressure, WC grain size, grain size distribution, Co-content, and pressing agent. Pressing tools are expensive to make and are therefore made for a standard shrinkage such as 18%. The shrinkage is obtained by applying sufficient pressing pressure to the compact so as to give the desired green density. It is extremely important that the sintered body has a size as close as possible to that desired in order to avoid expensive post sintering operations such as grinding. However, if the grain size is fine, for example one micron or less, a higher pressing pressure is needed to obtain the necessary shrinkage. It is thought in the industry that increasing internal friction within carbide powders of decreasing grain size causes greater resistance to compaction. A high pressing pressure is not desirable because of a greater risk of pressing defects such as cracks or pores in the pressed bodies, abnormal wear of the press tools and even risk of pressing tool failure including injuries to humans. Moreover, dimensional control of the sintered part is facilitated if the pressing pressure in kept within a certain desired and practicable range.

Fatty acids and their salts and esters are long known in industry for their lubricant properties. They are sometimes characterized by the length of their carbon chains. Oleic acid and stearic acid are both 18 carbon chain equivalents often referred to as C-18 and erucic acid and behenic acid have one of the longest carbon chains in naturally occurring fatty acids (C-22).

A method of lowering the compacting pressure for submicron cemented carbide is disclosed in EP-A-1043413. The method consists in premixing all components except WC for about three hours, adding the WC powder and then finally milling for about ten hours.

OBJECTS AND SUMMARY OF THE INVENTION

It is an object of the present invention to provide methods of reducing the pressing pressure when making fine grained cemented carbides.

It is an object of the invention to avoid or alleviate the prior art.

In one aspect of the invention there is provided a method of making a cemented carbide powder with low compaction pressure comprising using from about 1 to about 3 wt-% of a pressing agent of equal to or less than about 90 wt-% PEG and equal to or greater than about 10 wt-% of long chain C≧20 fatty acids, their esters and salts.

In another aspect of the invention there is provided a ready-to-press cemented carbide powder with low compaction pressure containing from about 1 to about 3 wt-% pressing agent of equal to or less than about 90 wt-% PEG and equal to or greater than about 10 wt-% of long chain C≧20 fatty acids, their esters and salts.

DETAILED DESCRIPTION OF THE PREFERRED EMBODIMENTS

According to the method of the present invention, cemented carbide powders are made by wet milling powders forming hard constituents and powders forming binder phase together with a particular pressing agent after which the slurry is dried, preferably by spray drying, to form agglomerates with good flow properties.

It has now surprisingly been found that a cemented carbide powder with a reduced compacting pressure at a predetermined weighing in of 18% shrinkage can be obtained by using from about 1 to about 3 wt-% pressing agent with the following composition: equal to or less than about 90 wt-% PEG and equal to or greater than about 10 wt-% of long chain C≧20 fatty acids, their esters and salts, preferably from about 90 to about 60 wt-%, most preferably from about 90 to about 65 wt-%, PEG and preferably from about 10 to about 40 wt-%, most preferably from about 10 to about 35 wt-%, fatty acids, their esters and salts.

In one embodiment, saturated, poly-unsaturated and, in particular, mono-unsaturated fatty acids are used and in another, dioic, two acid groups, long chain fatty acids are used.

In a preferred embodiment, the said fatty acids are erucic acid and/or behenic acid.

The method of the present invention can be applied to any cemented carbide composition, but preferably to cemented carbides comprising WC and from about 2 to about 20 wt-% binder, usually cobalt but possibly with alloying additions such as nickel or iron, preferably from about 6 to about 12 wt-% binder with grain growth inhibitors, in particular less than about 1 wt-% Cr and less than about 1 wt-% V. Preferably, the WC-grains have an average grain size in the range from about 0.1 to about 1.0 μm, preferably 0.2-0.6 μm, with essentially no WC grains greater than 1.5 μm.

The invention also relates to a ready to press cemented carbide powder with low compaction pressure containing from about 1 to about 3 wt-% pressing agent with the following composition: equal to or less than about 90 wt-% PEG and equal to or greater than about 10 wt-% of long chain C≧20 fatty acids, their esters and salts, preferably from about 90 to about 60 wt-%, most preferably from about 90 to about 65 wt-%, PEG and preferably from about 10 to about 40, most preferably from about 10 to about 35 wt-%, fatty acids, their esters and salts. Erucic acid and/or behenic acid are the preferred fatty acids. The cemented carbide powder has the following composition comprising WC and from about 2 to about 20 wt-% binder, usually cobalt but possibly with alloying additions such as nickel or iron, preferably from about 6 to about 12 wt-% binder with grain growth inhibitors, in particular less than about 1 wt-% Cr and less than about 1 wt-% V. The WC-grains preferably have an average grain size in the range from about 0.1 to about 1.0 μm, preferably from about 0.2 to about 0.6 μm, with essentially no WC grains greater than 1.5 μm.

The invention is additionally illustrated in connection with the following examples, which are to be considered as illustrative of the present invention. It should be understood, however, that the invention is not limited to the specific details of the examples.

EXAMPLE 1

A sub-micron cemented carbide mixture with composition 10 wt-% cobalt, less than 1 wt-% chromium and balance 0.4 μm tungsten carbide (WC) powder, was produced according to the invention with various admixtures of PEG and erucic acid, each admixture of which totaled about 2 wt-% of the powder weight. The milling was carried out in ethanol etc.

The pressing pressures for a sintering shrinkage of 18% were measured:

| PEG (wt %) | Erucic Acid (wt-%) | 18% | Shrinkage Pressure (MPa) |
|---|---|---|---|
| 2.0 | 0 | 135 | Prior art |
| 1.9 | 0.1 | 118 | Outside invention |
| 1.8 | 0.2 | 98 | Invention |
| 1.6 | 0.4 | 78 | Invention |
| 1.5 | 0.5 | 79 | Invention |

For this grain size of WC, an optimized exchange of 0.4 wt-% PEG with erucic acid achieved a 42% reduction in pressing pressure to achieve 18% sintering shrinkage.

EXAMPLE 2

A submicron cemented carbide powder mixture with composition the same as Example 1 but using a finer WC of 0.2 micron grain size was produced according to the invention. Again the milling was carried out in ethanol. Various admixtures of PEG and other fatty acids each totaling between about 1.5 and about 2.0 wt % of the powder weight were tested. The constant max press load of 4000 kg was insufficient to press out PS21 test pieces in these very fine carbide powders to the 19% target shrinkage (i.e. >190 MPa). Therefore pressed height and shrinkage were measured on two samples per variant (with small spread).

The following pressing agents were used:

| PEG (wt-%) | Fatty Acid, wt-% | Pressed Height, mm | Shrinkage, % |
|---|---|---|---|
| 2.0 | — | 7.34 | 23.4 |
| 1.5 | 0.5 Oleic | 7.22 | 23.0 |
| 1.5 | 0.5 Stearic | 7.22 | 23.1 |
| 1.5 | 0.5 Erucic | 7.15 | 22.8 |
| 1.5 | 0.5 Behenic | 7.15 | 22.8 |
| 1.5 | — | 7.29 | 23.3 |
| 1.0 | 0.5 Erucic | 6.92 | 21.9 |
| 1.0 | 0.7 Erucic | 6.81 | 21.4 |
| 0.5 | 1.0 Erucic | 6.67 | 20.9 |
| — | 1.5 Erucic | 6.59 | 20.7 |

The longer chain (>or=C20) fatty acids were found to be most effective as lubricants for pressing 0.2 micron carbide powders, being most effective used on their own without PEG. But PEG gives better green strength to the compact and for this reason some PEG may need to be retained.

EXAMPLE 3

A cemented carbide powder mixture of composition 7.0 wt-% cobalt, <1.0 wt-% chromium, <1.0 wt-% vanadium and balance 0.3 μm WC powder was produced according to the invention. Two variants admixed with either 1.5 wt-% PEG or 1.0 wt-% PEG and 0.5 wt-% erucic acid were tested:

| PEG wt-% | Erucic Acid (wt-%) | Pressing Pressure (MPa) | Shrinkage (%) |
|---|---|---|---|
| 1.5 | — | >190 | 20.7 |
| 1.0 | 0.5 | 93 | 20.1 invention |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Method of making a cemented carbide powder with low compaction pressure comprising using from about 1 to about 3 wt-% of a pressing agent of equal to or less than about 90 wt-% PEG and equal to or greater than about 10 wt-% of long chain C≧20 fatty acids, their esters and salts.

2. A method of claim 1 wherein said fatty acids are saturated, poly-unsaturated and mono-unsaturated fatty acids.

3. A method of claim 2 wherein said fatty acids are erucic acid and/or behenic acid.

4. A method of claim 1 comprising using long chain fatty acids with two acid groups.

5. A method of claim 1 wherein the powder comprises in addition, WC, and from about 2 to about 20 wt-% binder.

6. A method of claim 5 wherein the WC-grains have an average grain size in the range from about 0.1 to about 1.0 μm.

7. A method of claim 1 wherein the pressing agent comprises from about 90 to about 60 PEG and from about 10 to about 40 of the fatty acid, its ester or salt.

8. A method of claim 7 wherein the pressing agent comprises from about 90 to about 65 PEG and from about 10 to about 35 of the fatty acid, its ester or salt.

9. A method of claim 5 wherein said binder comprises cobalt.

10. A method of claim 5 wherein said binder comprises from about 6 to about 12 wt-% binder with grain growth inhibitors.

11. A method of claim 10 wherein said grain growth inhibitors comprise less than about 1 wt-% Cr and less than about 1 wt-% V.

12. A ready-to-press cemented carbide powder with low compaction pressure containing from about 1 to about 3 wt-% pressing agent of less than about 90 wt-% PEG and greater than about 10 wt-% of long chain C≧20 fatty acids, their esters and salts.

13. A ready-to-press cemented carbide powder of claim 12 wherein said fatty acids are erucic acid and/or behenic acid.

14. A ready-to-press cemented carbide powder of claim 12 also comprising WC, and from about 2 to about 20 wt-% binder.

15. A ready-to-press cemented carbide powder of claim 14 wherein the WC-grains have an average grain size in the range from about 0.1 to about 1.0 μm.

16. A ready-to-press cemented carbide powder of claim 12 wherein the pressing agent comprises from about 90 to about 60 wt-% PEG and from about 10 to about 40 wt-% of the fatty acid, its ester or salt.

17. A ready-to-press cemented carbide powder of claim 16 wherein the pressing agent comprises from about 90 to about 65 wt-% PEG and from about 10 to about 35 wt-% of the fatty acid, its ester or salt.

18. A ready-to-press cemented carbide powder of claim 12 wherein said binder comprises cobalt.

19. A ready-to-press cemented carbide powder of claim 12 wherein said binder comprises from about 6 to about 12 wt-% binder with grain growth inhibitors.

20. A ready-to-press cemented carbide powder of claim 19 wherein said grain growth inhibitors comprise less than about 1 wt-% Cr and less than about 1 wt-% V.

* * * * *